US007007582B2

(12) United States Patent
Iwamoto et al.

(10) Patent No.: US 7,007,582 B2
(45) Date of Patent: Mar. 7, 2006

(54) DIE DEVICE

(75) Inventors: Masami Iwamoto, Isehara (JP); Shigeru Endo, Isehara (JP)

(73) Assignee: Amada Company, Limited, (JP)

( * ) Notice: Subject to any disclaimer, the term of this patent is extended or adjusted under 35 U.S.C. 154(b) by 0 days.

(21) Appl. No.: 10/399,911

(22) PCT Filed: Oct. 23, 2001

(86) PCT No.: PCT/JP01/09284

§ 371 (c)(1),
(2), (4) Date: Apr. 24, 2003

(87) PCT Pub. No.: WO02/34426

PCT Pub. Date: May 2, 2002

(65) Prior Publication Data

US 2004/0011178 A1 Jan. 22, 2004

(30) Foreign Application Priority Data

Oct. 26, 2000 (JP) ..... 2000-326577
Aug. 10, 2001 (JP) ..... 2001-244316

(51) Int. Cl.
*B26F 1/14* (2006.01)

(52) U.S. Cl. ..... 83/686; 83/698.91
(58) Field of Classification Search ..... 83/698.91, 83/686, 684, 697, 699.31, 699.41, 699.51, 83/699.61, 698.71
See application file for complete search history.

(56) References Cited

U.S. PATENT DOCUMENTS

| | | | | |
|---|---|---|---|---|
| 4,375,774 A | | 3/1983 | Wilson et al. | |
| 5,329,835 A | * | 7/1994 | Timp et al. | 83/686 |
| 5,647,256 A | * | 7/1997 | Schneider | 83/698.91 |
| 5,839,341 A | * | 11/1998 | Johnson et al. | 83/698.91 |
| 5,884,546 A | * | 3/1999 | Johnson | 83/698.91 |
| 6,276,247 B1 | * | 8/2001 | Helda | 83/684 |

FOREIGN PATENT DOCUMENTS

| | | |
|---|---|---|
| JP | 04-108922 | 9/1992 |
| JP | 06-000551 | 1/1994 |
| JP | WO-94/07625 | 4/1994 |
| JP | WO 94/07663 | 4/1994 |
| JP | 08-267157 | 10/1996 |
| JP | 09-029354 | 2/1997 |
| JP | 10-113725 | 5/1998 |
| JP | 2000-288656 | 10/2000 |
| JP | 2001-105044 | 4/2001 |

OTHER PUBLICATIONS

International Search Report mailed Jan. 29, 2002.

* cited by examiner

*Primary Examiner*—Stephen Choi
(74) *Attorney, Agent, or Firm*—Blank Rome LLP

(57) ABSTRACT

When a retainer collar 77 is rotated with respect to a punch guide 29 in a turnable manner, an upper punch driver 49 which pierces the retainer collar 77 so as to be movable up and down is rotated with respect to the punch guide 29. As a result, since the upper punch driver 49 is screwed into a lower punch driver 37 and is rotated with respect to the lower punch driver 37 provided on the punch guide 29 movably up and down, an up-down positional relationship between the upper punch driver 49 and the lower punch driver 37 can be adjusted.

5 Claims, 7 Drawing Sheets

DIE DEVICE

This application is a Chapter II National Phase application claiming priority from PCT/JP01/09284, international filing date of Oct. 23, 2001, priority date claimed Oct. 26, 2000, the full disclosure of which is incorporated by reference herein.

TECHNICAL FIELD

The present invention relates to a die device which is attached to a suitable punch press such as a turret punch press so as to be used. More specifically, the invention relates to the die device, which is configured to have a punch body with a punch blade portion on its lower end is equipped with a punch guide so as to freely move up and down, and a disc-shaped stripper blade encircling the punch blade portion is detachably provided on a lower end of the punch guide and in which attachment/detachment and fixing of the stripper plate are easy and secure and height adjustment after repolishing of the punch blade portion is easy.

BACKGROUND ART

A prior example of the present invention includes Japanese Patent Application Laid-Open No. 10-113725 (1998) (prior example 1) and Japanese Patent Application Laid-Open No. 2000-288656 (prior example 2).

In the prior example 1 (Japanese Patent Application Laid-Open No. 10-113725 (1998)), a punch body having a punch blade portion on its lower end is provided in a cylindrical punch guide so as to be movable up and down, an oscillation locking piece having a latch portion being freely engaged with an engagement groove formed on an outer peripheral surface of a stripper plate on its lower end is provided on a lower end of the punch guide so as to freely oscillate to an inside-outside direction and be energized to an outside direction, and a turning ring, which has a locking piece pressuring portion for pressuring the oscillation locking piece to an inside direction so that the latch portion of the oscillation locking piece is engaged with the engagement groove of the stripper plate, is turnably provided to the lower end of the punch guide.

In the prior example 1, although the stripper plate can be attached to and detached from the lower end of the punch guide comparatively easily, the oscillation locking piece is made of a plate spring and it is occasionally broken at the attachment portion to the punch guide.

In addition, since the configuration is such that the turning ring is energized to a turning direction by a coil spring so that the latch portion of the oscillation locking piece is maintained to be engaged with the engagement groove of the stripper plate, a further improvement is desired in relation to that the turning ring occasionally turns against an energizing force of the coil spring due to vibration or the like at the time of a punching workpiece.

On the other hand, in the prior example 2 (Japanese Patent Application Laid-Open No. 2000-288656), in a configuration that a punch body having a punch blade portion on its lower end is provided into a cylindrical punch guide so as to be movable up and down, and a disc-shaped stripper plate encircling the punch blade portion is detachably provided to a lower end of the punch guide, a stopper ring is elastically mounted between a ring member fixed to an upper end of a punch driver fitted to an upper portion of the punch guide so as to be movable only up and down and an upper surface of the punch guide, a punch head member having a punch head on its upper end is fitted into the punch driver rotatively, and an external thread portion provided to an upper portion of the punch body is screwed into an internal thread portion provided to the punch head member so that an up-down position is adjustable.

In the above configuration, although the height adjustment after repolishing of the punch blade portion can be made easily, it is difficult to grasp a repolishing quantity of the punch blade portion, and the internal thread portion and the external thread portion are occasionally screwed firmly at the time of assembly after the repolishing. Thus, a further improvement is desired.

The present invention is devised in order to solve the above problems, and its first object is to provide a die device in which the height adjustment after the repolishing of the punch blade portion is easy.

A second object of the present invention is to provide a die device which is capable of attaching/detaching and fixing the stripper plate easily and securely.

DISCLOSURE OF THE INVENTION

In order to achieve the above objects, a die device based on a first aspect of the present invention includes: a retainer collar being provided relatively on an upper portion of a punch guide so as to be freely turned and fixed, a lower punch driver connected to a punch body is being fitted and supported into the punch guide so as to freely move up and down; an upper punch driver into which the retainer collar is put so as to freely move up and down; and a lower punch driver, wherein in the above configuration, the upper punch driver and an upper portion of the lower punch driver are screwed into each other in an up-down adjustable manner.

According to the above configuration, when the retainer collar is rotated with respect to the punch guide so as to be turnable with respect to the punch guide, the punch driver pericing through the retainer collar movably up and down is rotated with respect to the punch guide. As a result, since the upper punch driver is screwed into the lower punch driver and the rotates with respect to the lower punch provided on the punch guide movably up and down, the upper punch driver moves up and down with respect to the lower punch driver.

In other words, when the retainer collar freely turns with respect to the punch guide and is rotated with respect to the punch guide, the upper punch driver piercing the retainer collar movably up and down is rotated with respect to the punch guide. As a result, since the upper punch driver is screwed into the lower punch driver and the is rotated with respect to the lower punch driver provided on the punch guide movably up and down, an up-down positional relationship between the upper punch driver and the lower punch driver is changed so that a punch height can be adjusted.

In the die device based on a second aspect depending from the first aspect, an engagement concave portion is provided in a vicinity of an outer peripheral portion of the retainer collar in a peripheral direction; and a latch member, which is maintained so as to be freely engaged with and disengaged from the engagement concave portion and normally in a engaged state, is provided on the upper portion of the punch guide in a diametrical direction so as to freely move.

In the above configuration, in a normal state, the latch member, which is provided on the upper portion of the punch guide movably to the center in the diametrical direction, is engaged with the engagement concave portion provided in the vicinity of the outer peripheral portion of the retainer collar in the peripheral direction, so that the retainer collar cannot rotate with respect to the punch guide. Meanwhile, when the latch member is moved to the inside in the diametrical direction so as to be disengaged from the engagement portion of the retainer collar, the retainer collar is enabled to rotate with respect to the punch guide.

In other words, in the normal state, the latch portion, which is provided on the upper portion of the punch guide movably to the center in the diametrical direction, is engaged with the engagement concave portion provided in the vicinity of the outer peripheral portion of the retainer collar in the peripheral direction, so that the retainer collar is disabled to rotate with respect to the punch guide. Meanwhile, when the punch height is adjusted, the latch member is moved to the inside in the diameterical direction so as to be disengaged from the engagement concave portion of the retainer collar, so that the retainer collar is enabled to rotate with respect to the punch guide. For this reason, when the retainer collar is rotated relatively with respect to the punch guide, the up-down positional relationship between the upper punch driver and the lower punch driver is easily adjusted so that the punch height can be adjusted.

A die device based on a third aspect of the present invention includes: a cylindrical punch guide; a punch body provided in the punch guide so as to freely move up and down, the punch body having a punch blade portion on its lower end; a disc shaped stripper plate detachably provided on a lower end of the punch guide, the disc shaped stripper plate encircling the punch blade portion; an engagement groove formed on an outer peripheral surface of the stripper plate; an oscillation locking piece provided with a latch portion being freely engaged with the engagement groove on its lower end, the engagement groove being provided on a lower end of the punch guide so as to freely oscillate to an inside-outside direction and being energized to the outside direction; and a turning ring having a locking piece pressuring portion for pressuring the oscillation locking piece to the inside direction against the energizing force in order to engage the latch portion of the oscillation locking piece with the engagement groove of the stripper plate, the turning ring being provided to a lower end of the punch guide rotatively, wherein in the above configuration, a locking member being engaged with an engagement concave portion provided on the turning ring so as to fix the turning ring is provided on the punch guide.

A die device based on a fourth aspect of the present invention includes: a cylindrical punch guide; a punch body provided in the punch guide so as to freely move up and down, a punch blade portion being provided on a lower end of the punch body; a disc shaped stripper plate detachably provided on a lower end of the punch guide, the stripper plate encircling the punch blade portion; an engagement groove formed on an outer peripheral surface of the stripper plate; an oscillation locking piece having a latch portion freely engaged with the engaged groove on its lower end, the engagement groove being provided on the lower end of the punch guide so as to freely oscillate to an inside-outside direction and being energized to the outside direction; and a turning ring having a locking piece pressuring portion for pressuring the oscillation locking piece to the inside direction against the energizing force in order to engage the latch portion of the oscillation locking piece with the engagement groove of the stripper plate, the turning ring being provided on the lower end of the punch guide so as to freely turn, wherein in the above configuration, the oscillation locking piece is loosely supported to a locking piece supporting member provided to the punch guide so as to freely oscillate; and an elastic member for energizing the oscillation locking piece to the outside direction is provided to the locking piece supporting member provided to the punch guide.

In a die device based on a fifth aspect of the present invetnion depending from the third or fourth aspect, the oscillation locking piece is loosely supported to the locking piece supporting member provided to the punch guide so as to freely oscillate; and the elastic member for energizing the oscillation locking piece to the outside direction is provided on the locking piece supporting member provided to the punch guide.

In a die device based on a sixth aspect of the present invetnion depending from one of the third through fifth aspects, an outer periphery surface of the turning ring is provided with a key groove corresponding to a key groove provided on the punch guide; and a takeout groove for removing the stripper plate is provided in a position opposed to the key groove.

In a die device based on a seventh aspect of the present invetnion depending from one of the third through sixth aspects, a plurality of balls for supporting the turning ring in a turnable manner are provided in a plurality of places on the lower end of the punch guide; and a close ring for closing an inside of a ball housing hole housing the balls is provided on a lower end inner peripheral surface of the punch guide.

In a die device based on an eighth aspect depending from one of third through seventh aspects, a key which is engaged with the key groove provided on the punch guide and freely moves up and down is provided on the punch body; and an abrasion amount scale showing an abrasion amount of the punch blade portion based on the up-down position of the key is provided on an outside of the key groove.

A die device based on a ninth aspect includes: a cylindrical punch guide; a punch body provided in the punch guide so a to freely move up and down, the punch body having a punch blade portion on its lower end; and a stripper portion provided on a lower en of the punch guide, the stripper portion encircling the punch blade portion, wherein in the configuration: a punch driver having a punch head on its upper end is provided to be fitted into a retainer collar so as to freely move only up and down, the retainer collar being provided on an upper portion of the punch guide so as to be freely turned and fixed; a strip elastic means for energizing the punch driver to an up direction is provided between the punch head and the retainer collar, a peripheral groove is provided on a lower surface of the retainer collar provided on the upper portion of the punch guide or an upper surface of the punch guide; a plurality of engagement concave portions are provided on an inside or an outside of the peripheral groove in a circumferential direction with suitable gaps; a stopper pin, upper end or lower end of which is freely engaged with the peripheral groove and the engagement concave portion, is provided on the upper portion of the punch guide or a lower portion of the retainer collar so as to freely move to a radiation direction; and the stopper pin is energized so that a state that the upper end or the lower end of the stopper pin is engaged with the engagement concave portion is always maintained.

In a die device based on a tenth aspect depending from the ninth aspect, the punch body is provided so as to be divided into an upper punch body and a lower punch body, the upper and lower punch bodies are provided to be connected integrally by a connecting tool; an external thread portion provide to an upper portion of the upper punch body is provided to be screwed into an internal thread portion formed on the punch driver so that a up-down position is freely adjusted; and a key which is engaged with a key groove formed on the punch guide is provided on the upper punch body in an up-down position adjustable state.

In a die device based on an eleventh aspect depending from the tenth aspect, an upper surface of the upper punch body or a lower surface of the punch driver is provided with an elastic member for preventing close contact between the upper surface and the lower surface.

In a die device based on a twelfth aspect depending from the tenth or eleventh aspect, the connecting tool which connects the upper and lower punch bodies is composed of a bolt having a fluid passage; and the lower punch body has a guide hole for guiding a fluid supplied via the fluid passage to an outer peripheral surface.

A die device based on a thirteenth aspect includes: a cylindrical punch guide; a punch body provided in the punch guide so as to freely move up and down, the punch body having a punch blade portion on its lower end; a disc shape stripper plate detachably provided on the lower end of the punch guide, the stripper plate encircling the punch blade portion; an engagement groove formed on an outer peripheral surface of the stripper plate; an oscillation locking piece having a latch portion on its lower end so as to be freely engaged with the engagement groove, the engagement groove being provided on the lower end of the punch guide so as to freely oscillate to an inside-outside direction and being energized to the outside direction; and a turning ring having a locking piece pressuring portion for pressuring the oscillation locking piece to the inside direction against the energizing force in order to engage the latch portion of the oscillation locking piece with the engagement groove of the stripper plate, the turning ring being provided on the lower end of the punch guide so as to freely turn, wherein in the above configuration: a punch driver having a punch head on its upper end is provided to be fitted into a retainer collar so as to freely move only up and down, the retainer collar being provided on an upper portion of the punch guide; the punch driver is provided so as to be energized to the up direction; the punch body is provided so as to be divided into an upper punch body and a lower punch body; the upper and lower punch bodies are provided to be connected integrally by a connecting tool having a fluid passage; an external thread portion provided on an upper portion of the upper punch body is provided to be screwed into an internal thread portion formed on the punch driver so that an up-down position is freely adjusted; the lower punch body is provided with a guide hole for guiding a fluid supplied via the fluid passage to an outer peripheral surface; a plurality of balls for supporting the turning ring in a turnable manner are provided on the lower end of the punch guide; and a close ring for closing an inside of a ball housing hole housing the balls is provided on a lower end inner peripheral surface of the punch guide.

As understood from the explanation of the above configuration, according to the third through thirteenth aspect of the present invention, the stripper plate can be attached and detached easily, and the stripper plate can be fixed to be held securely. Moreover, the repolishing of the punch blade portion and the height adjustment after that are easy, and the above-mentioned conventional problems can be solved.

THE BEST MODE FOR CARRYING OUT THE INVENTION

There will be explained below a die device of the present invention as a first embodiment.

Figure 1:
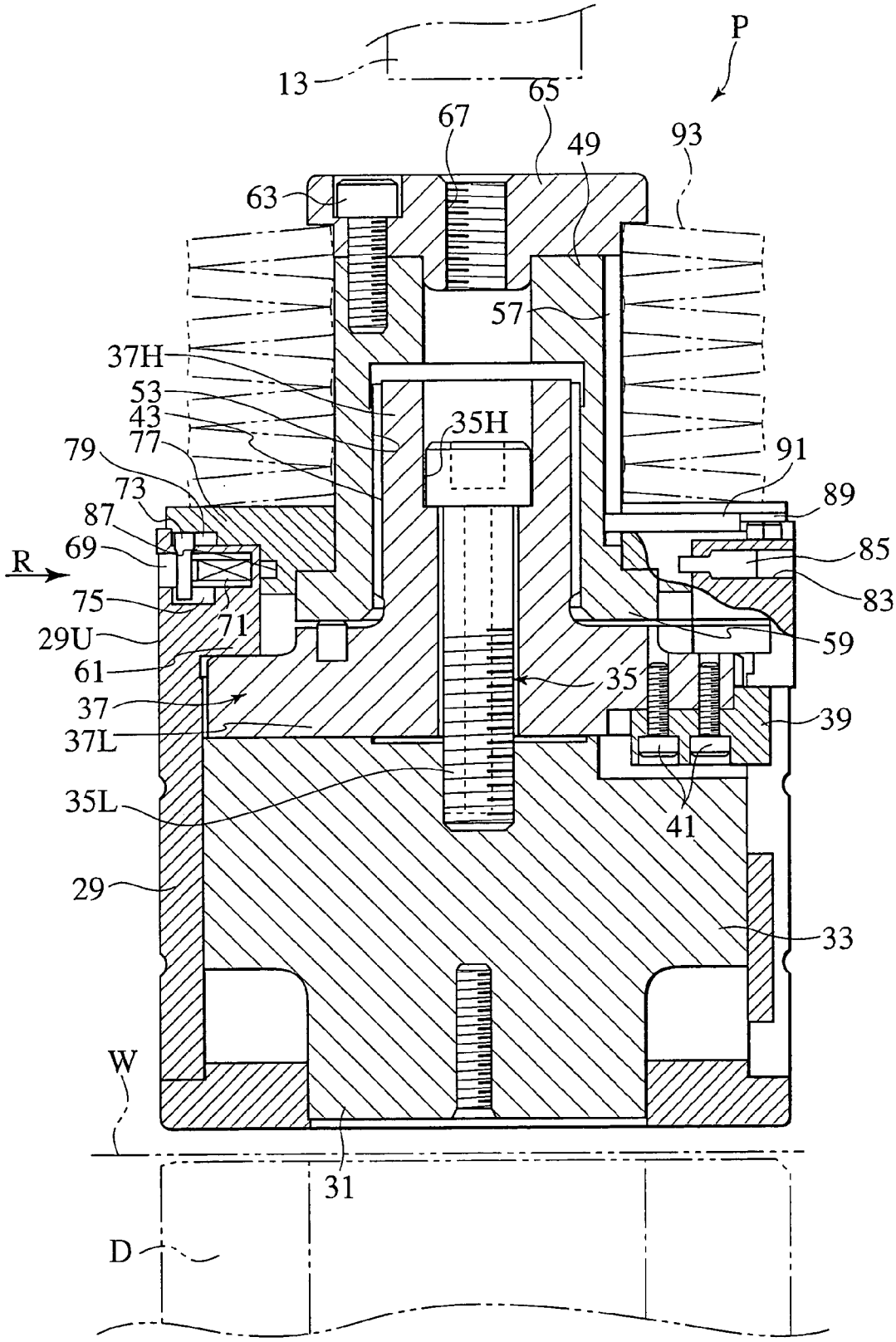
FIG. 1 is a sectional view showing a punch die as a die device of the present invention.

FIG. 1 is a sectional view showing a punch die P as the die device of the present invention. The punch die P can be mounted to an upper turret such as a turret punch press, and a punch body 33 having a punch blade portion 31 on its lower end is provided into a punch guide 29 so as to be movable up and down, and a lower punch driver 37 is mounted integrally to an upper side of the punch body 33 by a connecting bolt 35 in a normal state.

Here, a key 39 is mounted to a vicinity of a boundary between the punch body 33 and the lower punch driver 37 by bolts 41, and the punch body 33 and the lower punch driver 37 are supported integrally to the punch guide 29 so as not to rotate and be movable up and down.

Figure 3:
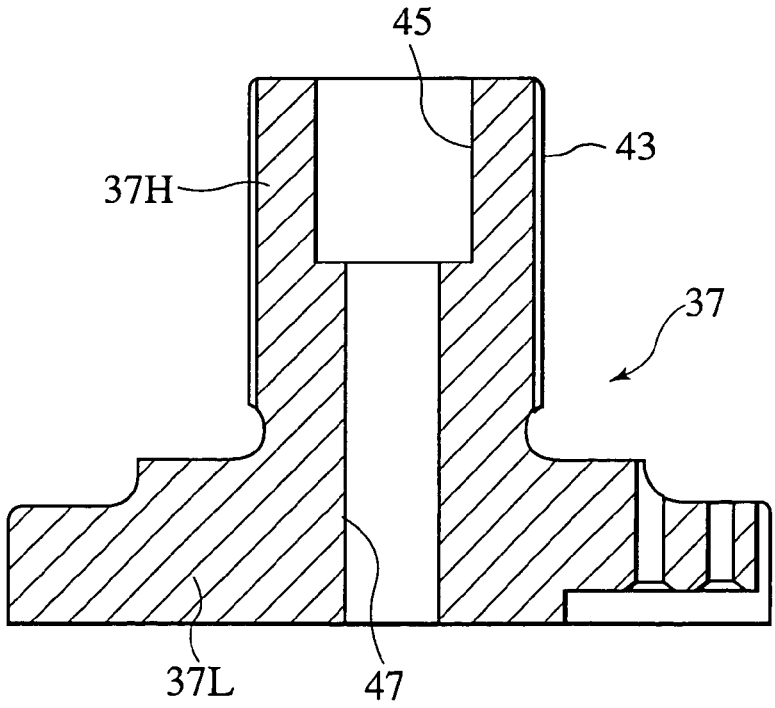
FIG. 3 is a sectional view showing a lower punch driver.

With reference to FIG. 3, the lower punch driver 37 has a convex portion 37H, which is provided with a thread portion 43 on its outer peripheral surface, on an upper side of a disc-shaped lower portion 37L. An upper portion of the convex portion 37H is provided with a hole 45 into which a head portion 35H of the connecting bolt 35 is fitted, and the convex portion 37H and the lower portion 37L are provided with an inner diameter through hole 47 through which an underhead 35L of the connecting bolt 35 is put.

Figure 2:
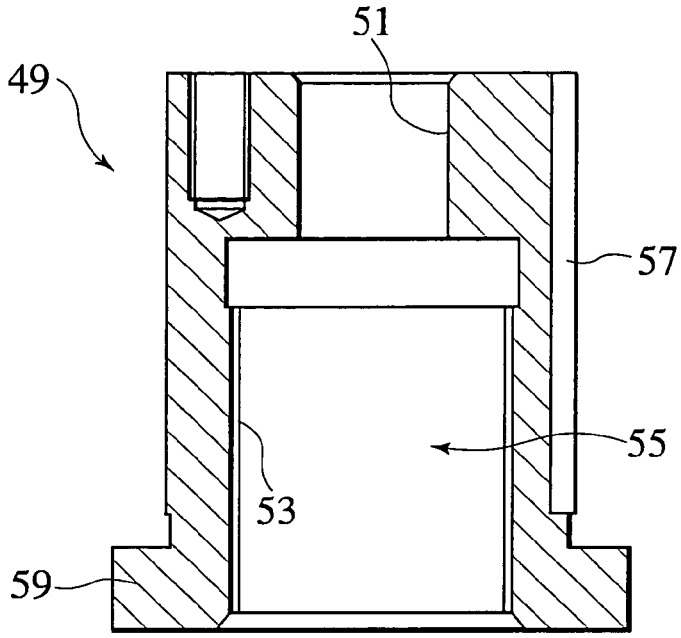
FIG. 2 is a sectional view showing an upper punch driver.

With reference to FIGS. 1 and 2, a cylindrical upper punch driver 49 is provided so as to cover an outside of the convex portion 37H. An inside of the upper punch driver 49 has a tool hole 51 for inserting a tool for rotating the connecting bolt 35 thereinto, and a space 55 provided with a thread portion 53 on its inner peripheral surface for screwing the convex portion 37H. Here, an outer peripheral surface of the upper punch driver 49 is provided with a key groove 57 in an up-down direction. Moreover, a lower end of the upper punch driver 49 has a flange portion 59 protruding outward.

Therefore, the upper punch driver 49 is relatively rotated with respect to the lower punch driver 37, so that an up-down position of the upper punch driver 49 with respect to the lower punch driver 37 can be adjusted by functions of the thread portions 43 and 53.

With reference to FIG. 1, the lower portion 37L of the lower punch driver 37 is supported to an upper end of the punch guide 29 by a retaining portion 61 protruding inward so as to be incapable of ascending and capable of descending.

Figure 6:
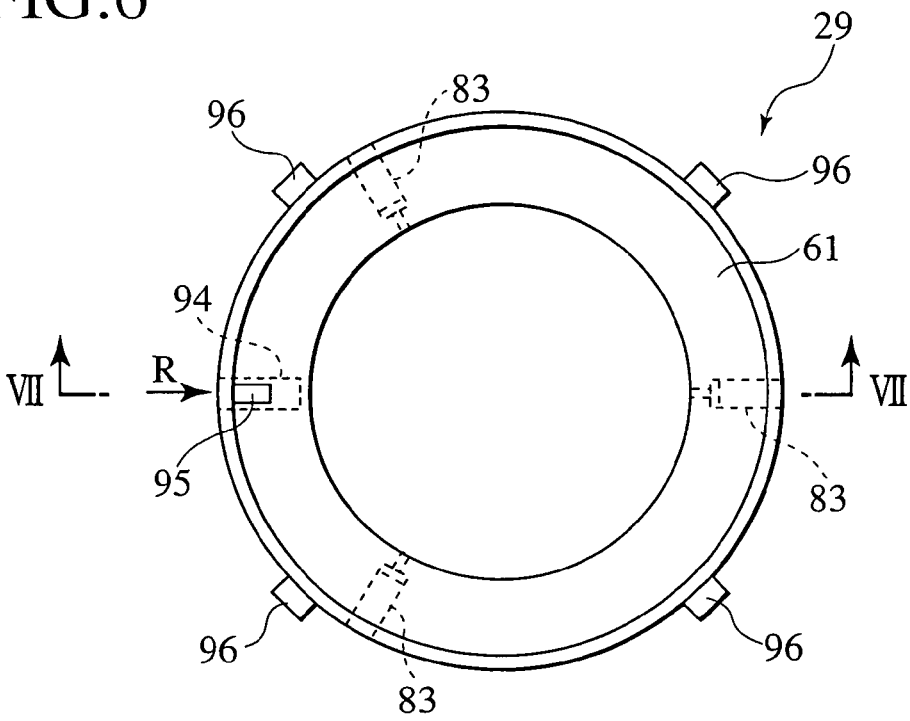
FIG. 6 is a plan view showing a punch guide.

In addition, as shown in FIG. 6, four supporting pins 96 are provided to an outside of the upper end of the punch guide 29 so as to protrude. Elastic means such as a coil spring is provided between an upper surface of an upper turret of the turret punch press and the supporting pins 96, and the punch die P of the present invention is always energized upward.

A punch head 65 is mounted to an upper end surface of the upper punch driver 49 by a connecting bolt 63. A center of the punch head 65 is provided with a tool inserting hole 67 for rotating the connecting bolt 35.

Further, there will be explained below a configuration where the up-down position of the upper punch driver 49 with respect to the lower punch driver 37 is adjusted by the functions of the thread portions 43 and 53 of the lower punch driver 37 and the upper punch driver 49.

Figure 7:
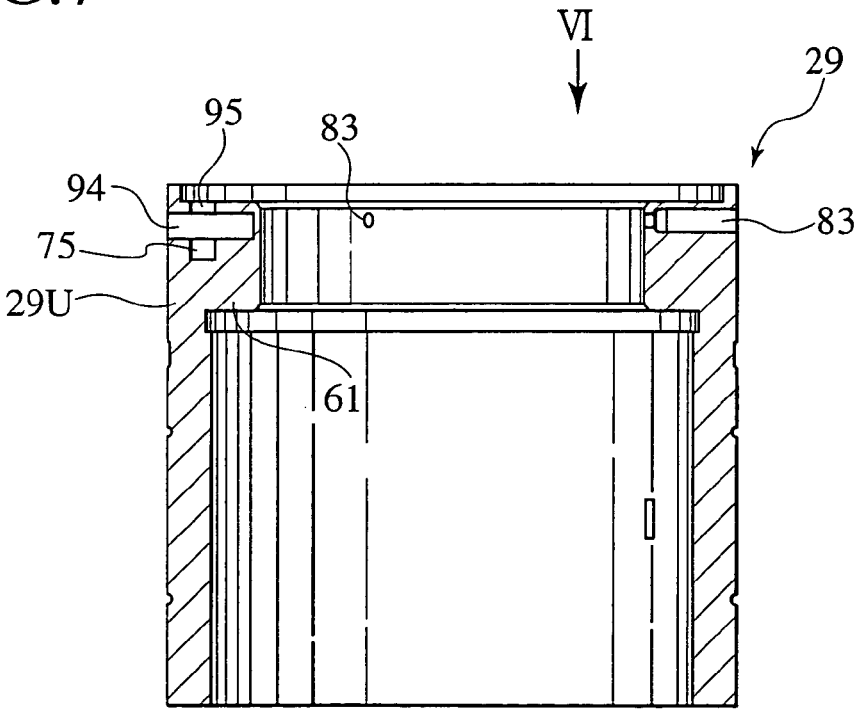
FIG. 7 is a sectional view in the direction of VII—VII in FIG. 6.

The punch guide 29 shown in FIGS. 6 and 7 is in a state before assembly of the punch die P of the present invention. An upper end 29U of the punch guide 29 is formed with a horizontal hole 94 which extends to a horizontal direction. The horizontal hole 94 is opened to an outer surface of the punch guide 29. The other end of the horizontal hole 94 does not pierce an inside surface of the retaining portion 61 and is hollow just before the inside surface of the retaining portion 61.

Further, an approximately center portion of the horizontal hole 94 is formed with another vertical hole 75 which extends to a vertical direction. The horizontal hole 94 and the vertical hole 75 are connected with each other. As shown in FIG. 6, the vertical hole 75 has an opening 95 on an upper end of the vertical hole 75 so that it upper end is opened to an upper surface of the retaining portion 61.

The horizontal hole 94 is provided with a push button 69 which is movable to a diametrical direction (a left-right direction in FIG. 1). The push button 69 is pressured to be energized to an outer direction by an elastic member 71 such as a coil spring. The push button 69 is provided with a stopper pin 73 as a latch member which pierces the push button 69 up and down in a fitted state.

The stopper pin 73 can move to a direction R of the horizontal direction (the left-right direction in FIG. 1) inside the vertical hole 75. Further, an upper end of the stopper pin 73 pierces the opening 95 provided to the upper end of the vertical hole 75 upward and protrudes upward from the opening 95. The stopper pin 73 can move to the direction R inside the vertical hole 75, but since it abuts against an outside wall of the vertical hole 75 so as not to slip out of the vertical hole 75.

Next with reference to FIGS. 1, 4 and 5, a configuration of a retainer collar 77 mounted into the upper portion of the punch guide 29 will be explained.

Arc shaped convex portions 80 are provided on a lower surface of the retainer collar 77 so as to protrude with equal gaps. In this embodiment, the ten convex portions 80 are formed. Moreover, engagement concave portions 81 are provided between the convex portions 80. Further, a peripheral groove 79 is provided inside the convex portions 80 on the lower surface of the retainer collar 77.

In other words, as shown in the drawings, the peripheral groove 79 is formed on the lower surface of the retainer collar 77, and its peripheral portion is provided with the ten engagement concave portions 81. When the engagement concave portions 81 and the peripheral groove 79 are formed, as a result the arc shaped convex portions 80 are formed to protrude on the lower surface of the retainer collar 77 with the equal gaps.

Figure 4:
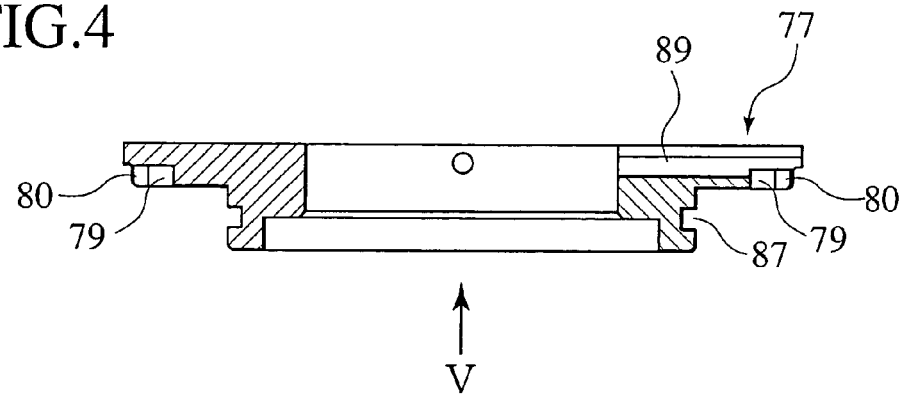
FIG. 4 is a sectional view showing a retainer collar.
Figure 5:
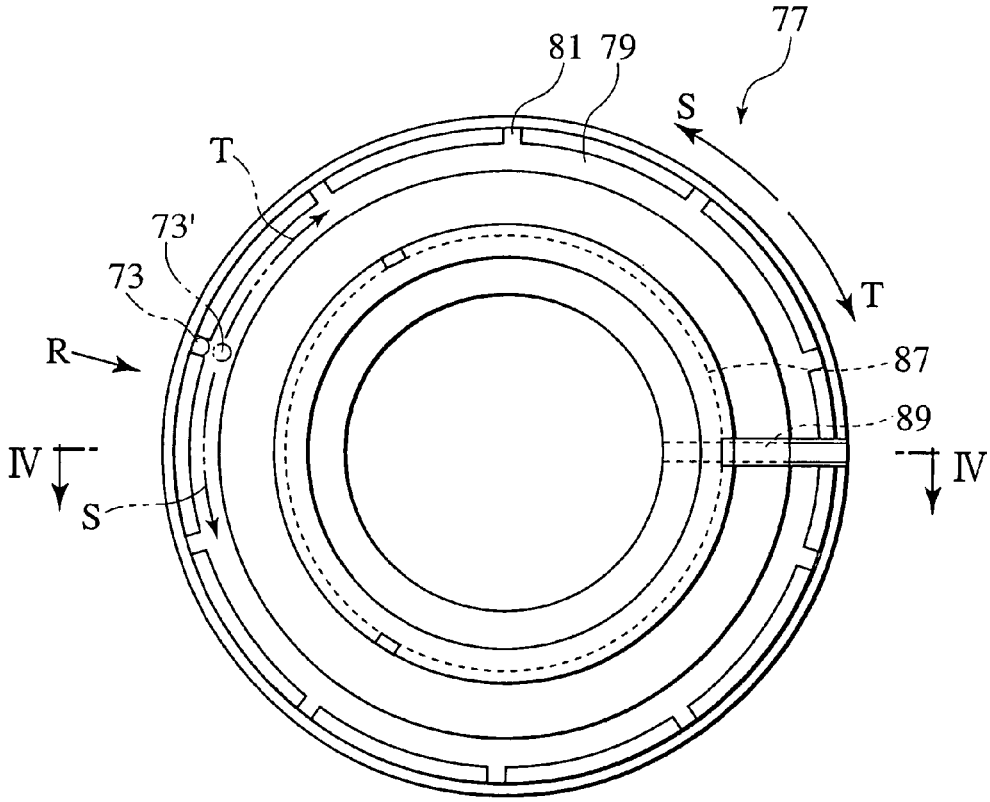
FIG. 5 is a view in the direction of V in FIG. 4 and a bottom diagram of the retainer collar.

With reference to FIG. 4, the upper end of the stopper pin 73 is provided so as to be engaged with the peripheral groove 79 formed on the lower surface of the retainer collar 77 and a plurality of the engagement concave portions 81 formed on a peripheral direction of the outside of the peripheral groove 79 with a predetermined pitch alternatively. In a normal state as shown in FIG. 1, the push button 69 is pushed down to the outer direction by the function of the elastic member 71 so that the upper end of the stopper pin 73 is engaged with the engagement concave portion 81, and a fixed state is obtained in such a manner that rotation of the retainer collar 77 with respect to the punch guide 29 is inihibited.

With reference to FIGS. 1, 6 and 7, the retaining portion 61 of the punch guide 29 is provided with three tapped holes 83 which pierce a radial direction with an interval of 120°, and setscrews 85 (see FIG. 1), for example, are screwed into the tapped holes 83, respectively, so that the retaining portion 61 is freely engaged with and disengaged from a retaining groove 87 of the retainer collar 77.

In addition, a through hole 89 which pierces the retainer collar 77 to a diametrical direction is provided (see FIGS. 4 and 5), and a spring pin 91 (see FIG. 1) which always protrudes to a center direction is provided on the through hole 89. Since the spring pin 91 is engaged with a key groove 57 (see FIG. 2) provided on the outer peripheral surface of the upper punch driver 49 in the up-down direction, the retainer collar 77 integrally rotates with respect to the upper punch driver 49 so as to be movable to the up-down direction.

As shown in FIG. 1, a stopper spring 93 is provided between the punch head 65 and the retainer collar 77. Due to repulsion of the stopper spring 93, the upper punch driver 49 is energized upward via the punch head 65 so as to be disengaged from the retainer collar 77. However, since the flange portion 59 of the upper punch driver 49 is retained by the retainer collar 77 in an unascendable state, the upper punch driver 49 does not slip off. Namely, the upper punch driver 49 is made to be a unit by a combination of the retainer collar 77, the stripper spring 93, the punch head 65 and the connecting bolt 63. Due to this unit state, as mentioned later, an adjusting operation on punch height of the present invention is easily performed.

In the above configuration, when a striker 13 strikes the punch head 65, as shown in FIG. 1, while the stripper spring 93 is being shrank, the punch blade portion 31 is descended via the upper punch driver 49, the lower punch driver 37 and the punch body 33, and a punching workpiece is carried out on a workpiecepiece W by a cooperation of the die D.

Next, the punch height adjusting operation will be explained. Firstly in a state that the upper end of the stopper pin 73 protrudes upward from the opening 95 so as to be engaged with the engagement concave portion 81 of the retainer collar 77, the push button 69 is pushed to the direction R. When the push button 69 is pushed to the direction R against the energizing force of the elastic member 71, the upper end of the stopper pin 73 is disengaged from the engagement concave portion 81 so as to be located in a position of the inner peripheral groove 79. Namely, as shown in FIG. 5, the stopper pin 73 is moved to the direction R to be in a position shown as a stopper pin 73'.

In this state, the stopper pin 73 can run to a direction S or a direction T in the peripheral groove 74. Therefore, the punch guide 29 can rotate to the direction S or T. The lower punch driver 37 is in a state that it cannot rotate with respect to the punch guide 29 due to the function of the key 39, due to the rotation of the punch guide 29 to the direction S or T, the lower punch driver 37 as well as the punch guide 29 integrally rotates to the same direction.

Therefore, the upper punch driver 49 rotates relatively with respect to the lower punch driver 37, and the lower punch driver 37 moves up and down with respect to the upper punch driver 49 due to the function between the thread portion 53 provided on the inner peripheral surface of the upper punch driver 49 and the thread portion 43 provided on the convex portion 37H of the lower punch driver 37.

For example, in the case where the ten engagement concave portions 81 are provided on the outside of the peripheral groove 79, when being rotated to an adjacent engagement concave portion 81, the upper punch driver 49 rotates by *frax*;1;10 revolution with respect to the lower punch driver 37, so that the lower punch driver 37 can be descended by *frax*;1;10 of the pitch of the thread portion 53 and the thread portion 43. N*amely*, the punch height can be adjusted so as to be higher by *frax*;1;10 of the *pitch*.

Here on the contrary to the above function, in a state that the push button 69 is maintained to be pushed, in other words, in a state that the upper end of the stopper pin 73 is disengaged from the engagement concave portion 81 so as to be located in the position of the inner peripheral groove 79, rotation of the punch guide 29 and the lower punch driver 37 is fixed, and the the upper punch driver 49, the retainer collar 77, the stripper spring 93, the punch head 65 and the connecting bolt 63 which form the unit as mentioned above are rotated to the direction S or T, so that the punch height can be adjusted.

When the up-down adjustment of the lower punch driver 37 with respect to the upper punch driver 49 is made and the pushing of the push button 69 is released, the push button 69 is moved to the outer direction by the energizing force of the elastic member 71, and the upper end of the stopper pin 73 is engaged with another engagement concave portion 81 so that the relative rotation of the retainer collar 77 is prevented.

From the above result, the push button 69 is pushed to the inner direction and the retainer collar 77 is rotated relatively with respect to the punch guide 29, so that the punch height can be adjusted easily.

Here, this invention is not limited to the above-mentioned first embodiment of the invention, and the invention can be carried out in another mode by suitable modification. Namely, the above-mentioned embodiment described the case where the ten engagement concave portions 81 are provided with the pitch of 36°, but a number of the engagement concave portions 81 is arbitrary. An adjusting quantity of the punch height can be set by a number of the engagement concave portions 81 and the pitches of the thread portion 53 and the thread portion 43.

Next, there will be explained below the die device according to a second embodiment of the present invention.

Figure 8:
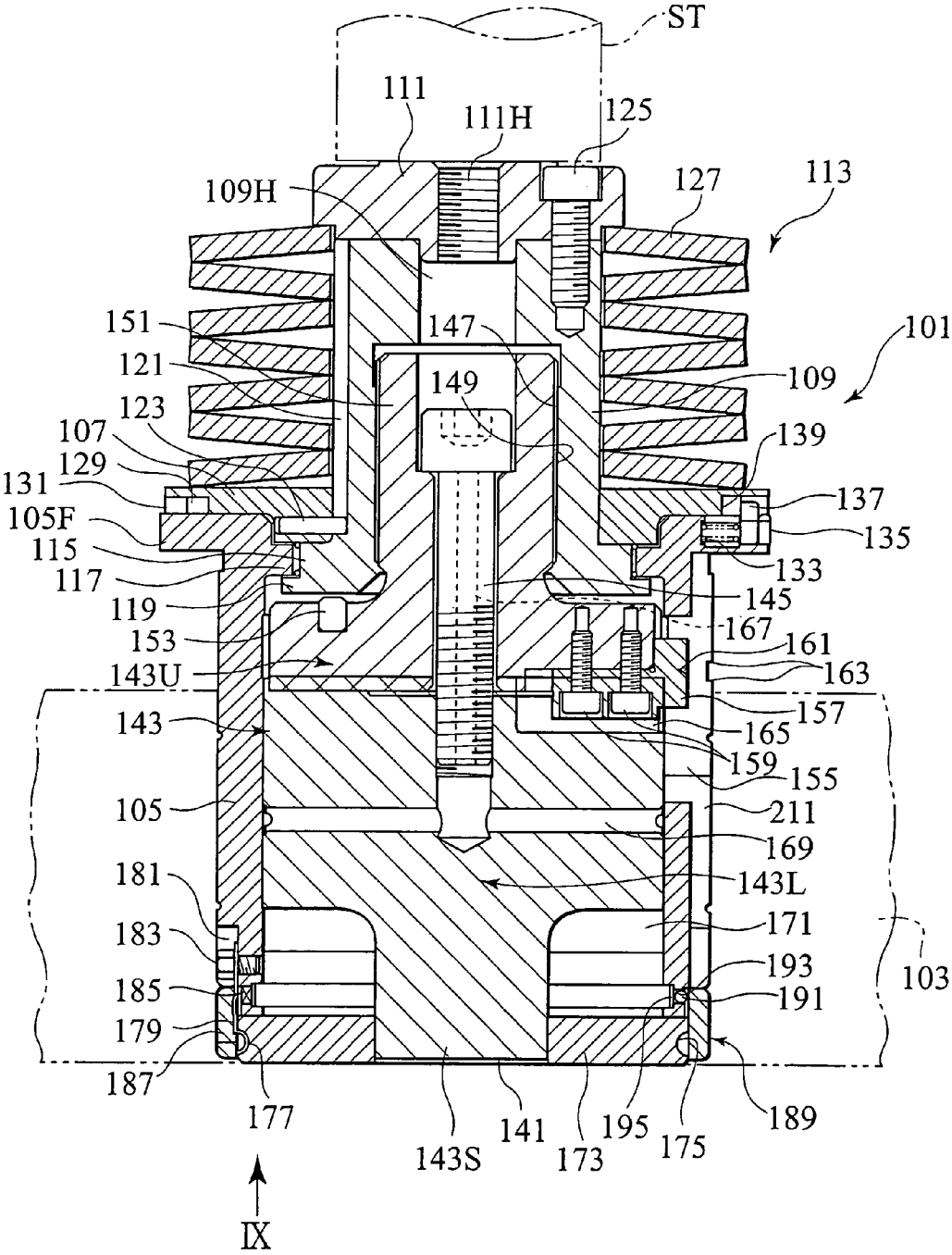
FIG. 8 is a sectional view of the die device based on a second embodiment of the present invention.

With reference to FIG. 8, a die device 101 according to the embodiment of the present invention has a cylindrical punch guide 105 which is supported to an upper die holder 103 in a punch press such as a turret punch press (corresponding to an upper turret in the turret punch press) so as to freely move up and down. This punch guide 105 is supported to the upper die holder 103 via a lifter spring (not shown) provided between a flange portion 105F provided on an upper portion of the punch guide 105 and the upper die holder 103 so as to be movable up and down.

A retainer collar 107 is provided to an upper surface of the punch guide 105 so as to be freely turned and fixed, and a strip elastic means (member) 113 for energizing a punch driver 109 piercing the retainer collar 107 movably only up and down to an upper direction is provided between a punch head 111 mounted to an upper end of the punch driver 109 and the retainer collar 107.

More specifically, the punch driver 109 pierces the retainer collar 107 from a lower direction so as to be movable up and down, and a lower end of the punch driver 109 is provided with a large diameter portion 115 which freely comes in contact with a lower surface of the retainer collar 107. A lower portion of the large diameter portion 115 is provided with a lower flange 119, and the lower flange 119 and the retainer collar 107 loosely nip an annular protruded portion 117 provided on an upper inner peripheral surface of the punch guide 105 to protrude to an inside direction.

The retainer collar 107 and the punch driver 109 integrally rotate, but a key 123 provided on the retainer collar 107 is engaged with a key groove 121 in an up-down direction formed on an outer peripheral surface of the punch driver 109 so that only the punch driver 109 moves up and down. An elastic member 127, such as a strong belleville spring, coil spring or urethane rubber is elastically mounted as one example of the strip elastic means 113 between the punch head 111 mounted to the upper end of the punch driver 109 via a plurality of bolts 125 and the retainer collar 107, and the punch driver 109 is always energized to the upper direction.

Here, the retainer collar 107 is provided with a plurality of arc shaped convex portions, engagement concave portions and peripheral grooves similarly to the configuration described in the first embodiment.

As mentioned above, the peripheral groove 129 is formed on the lower surface of the collar retainer 107 so that the collar retainer 107 is supported to the punch guide 105 to be freely turned and fixed, and a plurality of engagement concave portions 131 are provided in a circumferential direction onto an inside or outside of the peripheral groove 129 (in this example, on the outside) with suitable gaps. A guide groove 133 in a radial direction (radiation direction) is formed on an upper surface of the flange portion 105F in the punch guide 105, and a stopper pin 137, which freely moves to a position where its upper end is engaged with the peripheral groove 129 or a position where it is engaged with the engagement concave portion 131, is mounted to a slide member 135 which is slidably engaged with the guide groove 133. Moreover, the slide member 135 is energized by an elastic member 139 such as a coil spring mounted into the guide groove 133 so as to be always maintained in a state that the stopper pin 137 is engaged with the engagement concave portion 131.

In the above configuration, when the slide member 135 is moved against the energizing force of the elastic member 139 and the stopper pin 137 is moved from the position where it is engaged with the engagement concave portion 131 to the position where it is engaged with the peripheral groove 129, the retainer collar 107 is turnable with respect to the punch guide 105.

Therefore, when the retainer collar 107 turns with respect to the punch guide 105, the punch driver 109 is also turned integrally via the key 123.

Thereafter, when the movement of the slide member 135 against the energizing force of the elastic member 139 is released, the stopper pin 137 is engaged with another engagement concave portion 131 by the energizing force of the elastic member 139, so that the retainer collar 107 is fixed into a state where it cannot turn.

Here, since the positions provided with the peripheral groove 129 and the engagement concave portion 131 and the position provided with the stopper pin 171 are relative, the configuration may be such that the peripheral groove 129 and the engagement concave portio 131 are provided on the upper surface of the flange portion 105F in the punch guide 105, and the stopper pin 171, lower end of which is freely engaged with the peripheral groove 129 and the engagement concave portion 131, is protruded from the retainer collar 107 to a lower direction and is movable to the radial direction.

A punch body 143 having a punch blade portion 141 on its lower end is fitted into the punch guide 105 so as to freely move up and down. The punch body 143 is divided into an upper punch body 143U and a lower punch body 143L, and the upper and lower punch bodies 143U and 143L are connected integrally by a connecting tool 145.

More specifically, a center portion of an upper surface of the upper punch body 143U is provided with an upward protruded portion 151 protruding to an upper direction, and an external thread portion 149, which is screwed into an internal thread portion 147 formed on an inner peripheral surface of the punch driver 109 so that its up-down position is freely adjusted, is formed on an outer peripheral surface of the upward protruded portion 151.

An upper surface of the upper punch body 143U which is opposed to a lower surface of the punch driver 109 is provided with an elastic member 153 such as urethane rubber for preventing close contact between the lower surface and the upper surface so as to protrude to the up direction. Here, the position provided with the elastic member 153 is relative, and it may be provided to the lower surface of the punch driver 109 so as to protrude to the down direction.

Further, a key 157, which is engaged with the key groove 155 provided on the punch guide 105 to be movable up an down, is mounted integrally to a lower surface of the punch body 143U by a plurality of bolts 159. An outer surface of the key 157 is provided with a mark 161 such as a horizontal line showing the relative up-down position with respect to the punch guide 105, and an adjustment mark 163 showing an adjusting range of the punch blade portion 141 is provided on an outside of the key groove 155 corresponding to the mark 161.

Here, in the case where the upper surface or the lower surface of the key 157 is used as a mark, the mark 161 can be omitted, and a relationship between the up-down position of the mar 161 of the key 157 and the position of the adjustment mark 163 is observed, so that an abrasion amount after the repolishing of the punch blade portion 141 can be grasped. In other words, the adjustment mark 163 performs a function of a kind of an abrasion amount scale. Therefore, an abrasion amount or a residual polishing allowance of the punch blade portion 141 can be grasped by the positional relationship between the marks 161 and 163.

In order to agree directivity of the upper punch body 143U with directivity of the lower punch body 143L, a key groove 165 which is engaged with the key 57 is formed on the upper surface of the lower punch body 143L. The lower punch body 143L having the punch blade portion 141 on its lower end is detachably mounted to the lower portion of the upper punch body 143U by the connecting tool 145 piercing the upward protruded portion 151 of the punch body 143U from the upper direction.

The connecting tool 145 is made of a bolt having a fluid passage 167 piercing an axial center portion up and down, and the lower punch body 143L into which the bolt is screwed is provided with a guide hole 169 for guiding a suitable fluid such as oil mist supplied via the fluid passage 167 to an outer peripheral surface of the lower punch body 143L.

Therefore, the fluid, which is supplied from a striker ST provided to a punch press (not shown) to be movable up and down via a through hole 111H of the punch head 11 and a through hole 109H of the punch driver 109, is guided to lubricate between the outer peripheral surface of the lower punch body 143L and the inner peripheral surface of the punch guide 105 via the fluid passage 167 of the connecting tool 145 and the guide hole 169, and is introduced into an annular compression chamber 171 between a small diameter portion 143S of the lower punch body 143L provided to a lower end of the punch blade portion 141 and a lower inner peripheral surface of the punch guide 105.

A disc shaped stripper plate 173 encircling the punch blade portion 141 is detachably mounted to the lower end of the punch guide 105. The stripper plate 173 is constituted so that a through hole into which the punch blade portion 141 is fitted is provided to a center portion of the stripper plate 173, and an engagement groove 175 such as a spherical groove is formed on its outer peripheral surface. In order to detachably support the stripper plate 173 to the lower end of the punch guide 105, an oscillation locking piece 179, which has a latch portion 177 being freely engaged with the engagement groove 175 on its lower end, is supported to a plurality of places on a lower end outer peripheral surface of the punch guide 105 so as to freely oscillate.

More specifically, a locking piece supporting member 183 such as a pin or a bolt mounted to a notch 181 formed on a plurality of places on the lower end outer peripheral surface of the punch guide 105 is loosely fitted into a hole provided on an upper portion of the oscillation locking piece 179, so that the oscillation locking piece 179 is supported in a radial direction (inside-outside direction) so as to be capable of oscillating, and is energized to the outside direction by an elastic member 185 such as a coil spring which intervenes between the oscillation locking piece 179 and the lower end of the punch guide 105. Namely, the oscillation locking piece 179 is supported in a state that it is not fastened nor fixed integrally to the punch guide 105 by the locking piece supporting member 183 but is suspended loosely.

In order to maintain a state that the latch portion 177 on the lower end of the oscillation locking piece 179 is engaged with the engagement groove 175 of the stripper plate 173, a turning ring 189, which has a locking piece pressuring portion 187 (see FIG. 9) for pressuring the oscillation locking piece 179 to the inside direction against the energizing force of the elastic member 185, is mounted to the lower end outer peripheral surface of the punch guide 105 so as to be freely turned and fixed.

Figure 11:
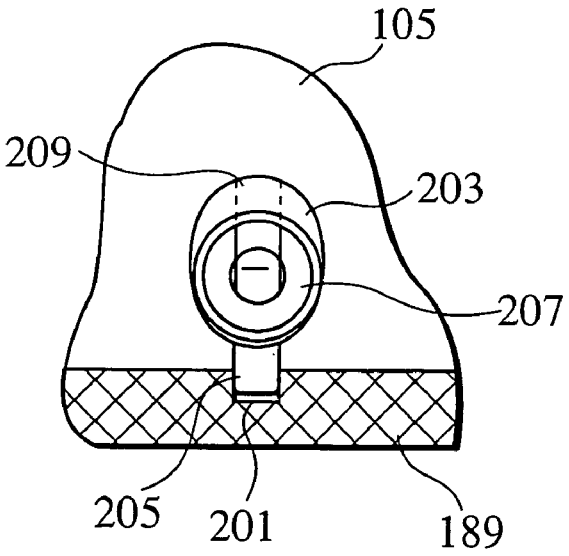
FIG. 11 is a view in the direction of XI in FIG. 10.

Here, In order to facilitate the rotation of the turning ring 189 with a hand so that the stripper can be replaced without using a tool, as shown in FIG. 11, knurl workpieceing is performed on the outer peripheral surface of the turning ring 189.

On the other hand, a ball housing hole 193 which houses a ball 191 (see FIG. 8) rotatively is formed on a plurality of places on the lower end of the punch guide 105, a part of the ball 191 is protruded from the ball housing hole 193 to the outside direction and is brought into contact with an inner peripheral surface of the turning ring 189, so that the turning ring 189 is supported so as to be turnable. In order to prevent slipping-off of the ball 191 from the ball housing hole 193 to the inside direction and close an inside of the ball housing hole 193, a closing ring 195 is engaged with the peripheral groove formed on the lower end inner peripheral surface of the punch guide 105 correspondingly to the ball housing hole 193.

Here, the ball housing hole 193 does not pierce up to the inner peripheral surface of the punch guide 105 and a punching workpiece is stopped just before the inner peripheral surface, so that the configuration can be modified into a configuration for preventing the slipping-off of the ball 191 can be provided. In this case, the closing ring 195 is not necessary, so that the configuration can be simplified.

A notched concave portion 197 (see FIG. 9), inside of which is opened, is formed in a position of the turning ring 189 corresponding to the oscillation locking piece 179, and the locking piece pressuring portion 187 is formed on the notched concave portion 97 so as to protrude to the inside direction, and a pressuring releasing portion 199 for releasing the pressuring of the oscillation locking piece 179 to the inside direction is formed so as to be adjacent to the locking piece pressuring portion 187.

Figure 9:
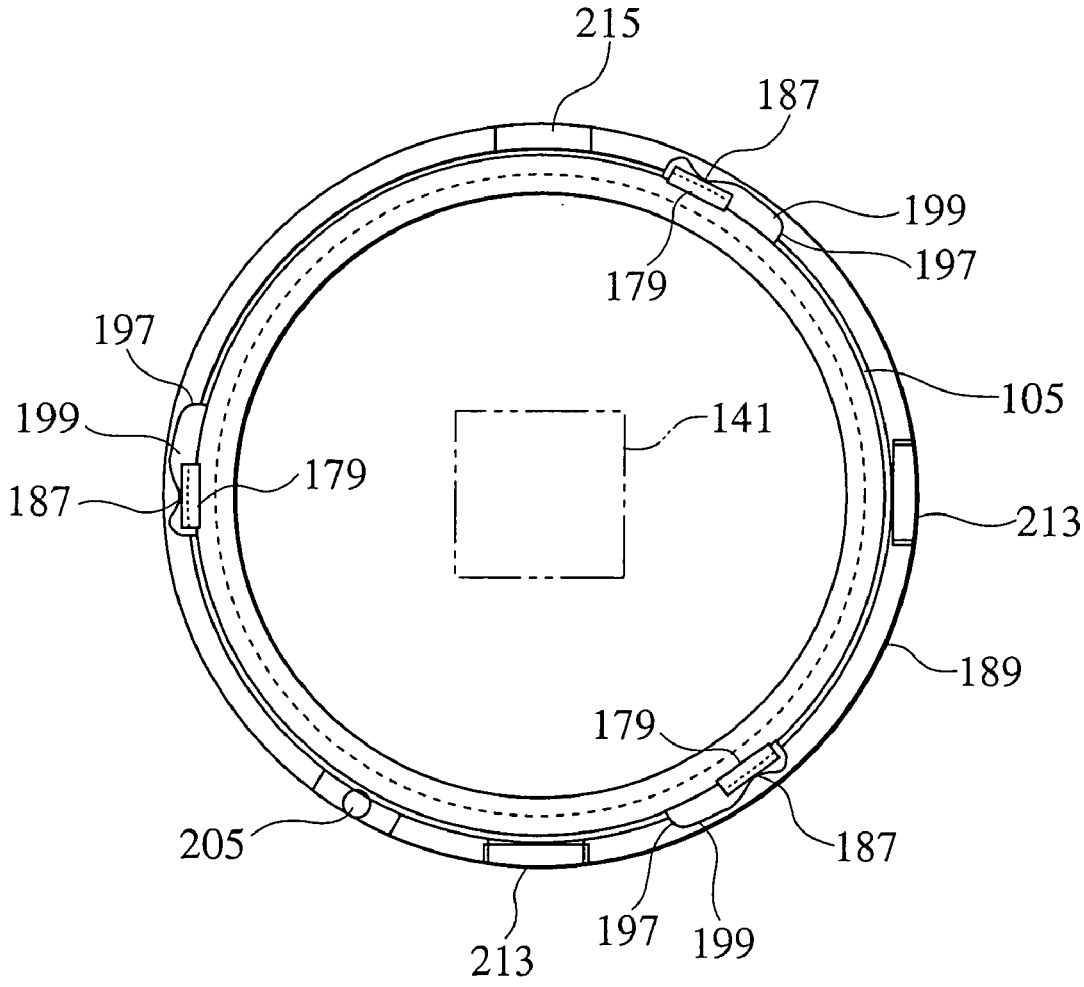
FIG. 9 is a bottom view of the die device.

Therefore, as shown in FIG. 9, in the state that the locking piece pressuring portion 187 abuts against the oscillation locking piece 179, the oscillation locking piece 179 is pressured to the inside direction, and the latch portion 177 of the oscillation locking piece 179 is engaged with the engagement groove 177 of the stripper plate 173. Further, when the turning ring 189 is turned to a counterclockwise direction in FIG. 9 and the pressurizing releasing portion 199 corresponds to the oscillation locking piece 179, the pressuring of the oscillation locking piece 179 is released, so that the stripper plate 173 is enabled to be attached and detached.

Figure 10:
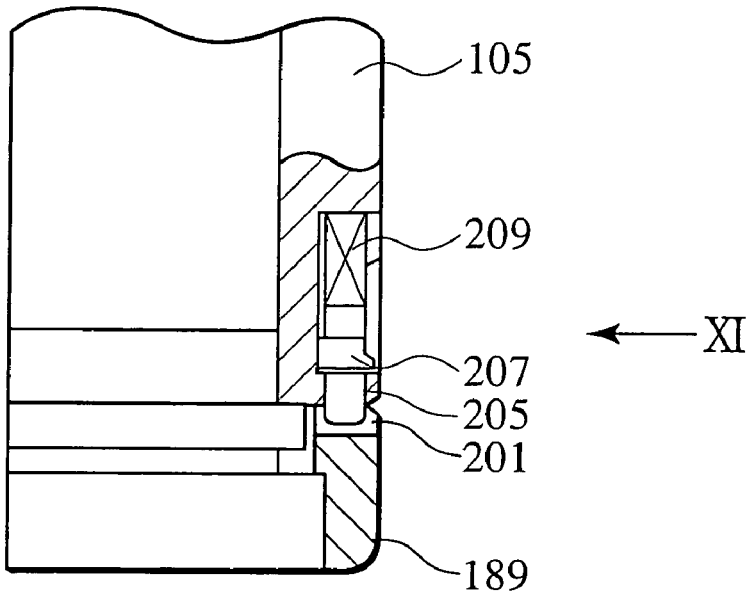
FIG. 10 is partially enlarged sectional view showing a mechanism portion for locking rotation of a turning ring of the die device.

In order to bring the turning ring 189 into a fixed state, an engagement concave portion 201 is formed on a suitable position on the upper portion of the turning ring 189 as shown in FIGS. 10 and 11, and a locking member 207, which has an engagement member 205 freely engaged with the engagement concave portion 201 on its lower portion, is provided in a concave portion 203 formed on the outer peripheral surface of the punch guide 105 so as to be movable up and down and is always energized to the down direction by an elastic member 209 such as a coil spring.

The state that the engagement member 205 is engaged with the engagement concave portion 201 of the turning ring 189 is the state such that the locking piece pressuring portion 187 pressures the oscillation locking piece 179 to the inside direction, namely, the unturnable state.

Incidentally, a key (not shown) for holding directivity of the die device 101 constant is provided to the upper die holder 103, a key groove 211 (see FIG. 8) which is freely engaged with and disengaged from the key is formed on the outer peripheral surface of the punch guide 105, and a key groove 213 (see FIG. 9) is formed on a position where the turning ring 189 corresponds to the key groove 211. Moreover, a takeout groove 215 such as a notched portion for dismounting the stripper plate 173 from the lower end of the punch guide 105 is formed on a position opposed to the key groove 123.

With the above configuration, similarly to the normal die device, when the die device 101 is attached to the upper die holder 103 in the punch press so as to be movable up and down and the punch head 111 is struck by the striker ST provided to the punch press movably up and down, the entire die device 101 is descended with respect to the upper die holder 103 against the lifter spring (not shown), and the stripper plate 173 provided to the lower portion comes in contact with a plate shaped workpiece (not shown) to be punched so that the workpiece is pressured to be fixed to a die (not shown) as a lower die.

Thereafter, when the striker ST is further descended, the punch head 111, the punch driver 109 and the upper and lower punch bodies 143U and 143L are integrally descended with respected to the punch guide 105 against the energizing force of the strip elastic means 113, so that the workpiece is punched by the punch blade portion 141 in cooperation of the die.

As mentioned above, when the punch head 11 is struck and descended by the striker ST, after a fluid of a lubricant such as oil mist is ejected and supplied in an atomized manner from a fluid supply port (not shown) provided on the striker ST to the through hole 111H of the punch head 111, the pressure fluid passes through the fluid passage 167 of the connecting tool 145 and the guide hole 169 of the lower punch body 143L and reaches to lubricate between the outer peripheral surface of the lower punch body 143L and the inner peripheral surface of the punch guide 105, and flows into the annular compression chamber 171.

When the punch body 143 is descended with respect to the punch guide 105, the fluid in the compression chamber 171 is compressed, and simultaneously when the workpiece is punched by the punch blade portion 141, the fluid is ejected from a minute gap between the circumference of the punch blade portion 141 and the inner peripheral surface of the through hole of the stripper plate 173 to the down direction, and blank or scrap in the die is ejected to be discharged to the down direction.

As mentioned above, when the fluid in the annular compression chamber 171 is compressed, it tends to be ejected from the ball housing hole 193 to the outside, but since the ball housing hole 193 is closed by the close ring 195, the fluid can be prevented from being ejected from the ball housing hole 193, so that the fluid can be compressed effectively in the compression chamber 171.

In the case where the punch blade portion 141 is abraded and needs to be repolished, in the state that the die device 101 is removed from the upper die holder 103, the stripper plate 173 is removed and the lower punch body 143L is removed so that the punch blade portion 141 is repolished.

In order to remove the stripper plate 173 from the lower end portion of the punch guide 105, in FIGS. 10 and 11, the locking member 207 is moved to the up direction against the elastic member 209, and the engagement member 205 is disengaged from the engagement concave portion 201 of the turning ring 189. When the turning ring 189 is turned to the counterclockwise direction in FIG. 9 and the pressuring of the oscillation locking piece 179 to the inside direction by means of the locking piece pressuring portion 187 is released, the oscillation locking piece 179 is moved to the outside direction by the function of the elastic member 185, and the latch portion 177 of the oscillation locking piece 179 is disengaged from the engagement groove 175 of the stripper plate 173 so that the fixing of the stripper plate 173 is released.

Thereafter, a finger is put into the takeout groove 215 of the turning ring 189 and holds the stripper plate 173, so that the stripper plate 173 can be removed from the lower end portion of the punch guide 105.

After the stripper plate 173 is removed from the punch guide 105 as mentioned above, a suitable tool is put into the through holes 111H and 109H of the punch head 111 and the punch driver 109, and the connecting tool 145 is turned to be loosened, so that the lower punch body 143L can be removed from the upper punch body 143U to the down direction. After the lower punch body 143L is removed in such a manner and the punch blade portion 141 is repolished, the punch blade portion 141 is put into the punch guide 105 from below, and the upper surface of the lower punch body 143L is brought into contact with the lower surface of the upper punch body 143U and the connecting tool 145 is tightened, so that the upper and lower punch bodies 143U and 143L can be fixed integrally.

Thereafter, the slide member 135 is moved against the elastic member 139, and when the punch driver 109 is turned via the punch head 111 in the state that the stopper pin 137 is located in the peripheral groove 129 of the retainer collar 107, the external thread portion 149 of the upper punch body 143U, which is screwed into the internal thread portion 147 of the punch driver 109, relatively turns, and the upper and lower punch bodies 143U and 143L move up and down relatively with respect to the punch driver 109, so that the height is adjusted. Namely, the punch body 143 is adjusted to be descended by an amount corresponding to a re-polishing amount of the punch blade portion 141.

Here, when the positional relationship between the mark 161 of the key 157 and the adjustment mark 163 provided on the outside of the key groove 155 is observed, a total re-polishing amount of the punch blade portion 141 can be grasped, so that a state can be grasped as to whether the punch blade portion 141 allows of re-polishing, namely, whether the lower punch body 143L reaches a life that it should be replaced.

As mentioned above, after the lower punch body 143L is mounted integrally to the lower portion of the upper punch body 143U, the stripper plate 173 is mounted to the lower end of the punch guide 105, and when the turning ring 189 is turned to the clockwise direction and the oscillation locking piece 179 is pressured to the inside direction by the locking piece pressuring portion 187 as shown in FIG. 9, the latch portion 177 of the oscillation locking piece 179 is engaged with the engagement groove 175 of the stripper plate 173 so that the stripper plate 173 is fixed.

Thereafter, as shown in FIGS. 10 and 11, when the engagement member 205 is engaged with the engagement concave portion 201 of the turning ring 189, the turning ring 189 is fixed in the unturnable manner to be brought into an initial state, and the turning of the turning ring 189 is inhibited due to oscillation or the like at the punching workpiece, so that the fixed state of the stripper plate 173 is maintained.

Incidentally, when the oscillation locking piece 179 is pressured and oscillated in and out as mentioned above, since the oscillation locking piece 179 is loosely supported to the locking piece supporting member 183 so as to freely oscillate, bending does not occur on the oscillation locking piece 179, and thus the oscillation locking piece 179 is not broken even due to long-time use.

In addition, in the case where the punch driver 109 is turned with respect to the upper punch body 143U as mentioned above so that the up-down position of the upper punch body 143U is adjusted relatively, when the lower surface of the punch driver 109 approaches the upper surface of the upper punch body 143U, the elastic member 153 is compressed and resistance becomes large. For this reason it can be grasped that the lower surface approaches the upper surface, and it can be previously prevented that the lower surface and the upper surface come in close contact with each other and the internal thread portion 147 and the external thread portion 149 are tightened firmly.

In addition, in the above configuration, as for a change in a shape of the punch blade portion 141, the other part of the configuration can be common by replacing the lower punch body 143L and the stripper plate 173 so that the common parts can be standardized, and even in the case where the shape of the punch blade portion is various, it can be manufactured easily and quickly.

What is claimed is:

1. A die device comprising:

a retainer collar being provided on an upper portion of a punch guide so as to be freely turned and fixed wherein a lower punch driver connected to a punch body is being fitted and supported in the punch guide so as to freely move up and down; and an upper punch driver inserted into the retainer collar so as to freely move up and down in a projecting manner;

wherein the upper punch driver and an upper portion of the lower punch driver are screwed into each other in an up-down adjustable manner;

wherein an engagement concave portion is provided in a vicinity of an outer peripheral portion of the retainer collar in a peripheral direction;

wherein a latch member, which is maintained so as to be freely engaged with and disengaged from the engagement concave portion and normally in an engaged state, is provided on the upper portion of the punch guide;

wherein when the latch member is moved from the peripheral portion of the punch guide toward the center portion of the punch guide in the radial direction of the punch guide, the latch member is disengaged from the engagement concave portion of the retainer collar, thereby the retainer collar can be turned relative to the punch guide so that the upper punch drive and an upper portion of the lower punch driver are screwed into each other in an up-down adjustable manner.

2. A die device comprising:

a cylindrical punch guide;

a punch body provided in the punch guide so as to freely move up and down, the punch body having a punch blade portion on its lower end; and a stripper portion provided on a lower end of the punch guide, the stripper portion encircling the punch blade portion, wherein in the configuration:

a punch driver having a punch head on its upper end is provided to be fitted into a retainer collar so as to freely move only up and down, the retainer collar being provided on an upper portion of the punch guide so as to be freely turned and fixed;

a strip elastic member energizing the punch driver to an up direction is provided between the punch head and the retainer collar;

a peripheral groove is provided on a lower surface of the retainer collar provided on the upper portion of the punch guide or an upper surface of the punch guide;

a plurality of engagement concave portions are provided on an inside or an outside of the peripheral groove in a circumferential direction with suitable gaps;

a stopper pin, upper end or lower end of which is freely engaged with the peripheral groove and the engagement concave portion, is provided on the upper portion of the punch guide or a lower portion of the retainer collar so as to freely move to a radial direction; and the stopper pin is energized so that a state that the upper end or the lower end of the stopper pin is engaged with the engagement concave portion is always maintained;

wherein when the stopper pin is moved from the peripheral portion of the punch guide or the retainer collar toward the center portion of the punch guide or the retainer collar in the radial direction of the punch guide or the retainer collar, the stopper pin is disengaged from the engagement concave portion, thereby the retainer collar can be turned relative to the punch guide so that the punch driver and an upper portion of the punch body are screwed into each other in an up-down adjustable manner.

3. The die device according to claim 2, wherein:

the punch body is provided so as to be divided into an upper punch body and a lower punch body;

the upper and lower punch bodies are provided to be connected integrally by a connecting tool;

an external thread portion provide to an upper portion of the upper punch body is provided to be screwed into an internal thread portion formed on the punch driver so that a up-down position is freely adjusted: and a key which is engaged with a key groove formed on the punch guide is provided on the upper punch body in an up-down position adjustable state.

4. The die device according to claim 3, wherein an upper surface of the upper punch body or a lower surface of the punch driver is provided with an elastic member for preventing close contact between the upper surface and the lower surface.

5. The die device according to claim 4, wherein:

the connecting tool which connects the upper and lower punch bodies is composed of a bolt having a fluid passage; and the lower punch body has a guide hole for guiding a fluid supplied via the fluid passage to an outer peripheral surface.

* * * * *